United States Patent [19]

Barazone

[11] Patent Number: 4,705,229

[45] Date of Patent: Nov. 10, 1987

[54] COMPACT APPARATUS FOR LAYING PAVING FABRIC

[76] Inventor: Mounque Barazone, P.O. Box 5217, Cottonwood, Calif. 96022

[21] Appl. No.: 769,677

[22] Filed: Aug. 27, 1985

Related U.S. Application Data

[63] Continuation-in-part of Ser. No. 542,475, Oct. 17, 1985, abandoned.

[51] Int. Cl.[4] ..... B65H 16/00; E01C 3/00; E01C 11/16

[52] U.S. Cl. ..... 242/86.52

[58] Field of Search ..... 242/86.52, 86.5 R, 86.4, 242/86.6, 76, 58, 68.4; 15/78; 26/87; 56/16.2, 15.9; 404/83, 93, 94, 103, 122; 254/327

[56] References Cited

U.S. PATENT DOCUMENTS

| | | | |
|---|---|---|---|
| 2,258,205 | 10/1941 | Halvorson | 404/103 |
| 3,632,054 | 1/1972 | Heppelman et al. | 242/86.52 X |
| 3,913,854 | 10/1975 | McClure | 242/86.52 X |
| 4,010,859 | 3/1977 | Ronian et al. | 254/327 X |
| 4,148,399 | 4/1979 | Carter et al. | 242/86.5 R X |
| 4,456,399 | 6/1984 | Conover | 404/83 X |
| 4,518,299 | 5/1985 | Vanderlei | 242/86.5 R X |

*Primary Examiner*—John M. Jillions
*Attorney, Agent, or Firm*—Bielen & Peterson

[57] ABSTRACT

A device for supporting a roll of material to a vehicle including a pair of arms pivotally attached to a frame. The roll supporting device includes a winch attached to the frame and a pulley attached to each arm. A pair of pulleys on the frame guide a winch cable from the winch to the pulley on each of the arms.

4 Claims, 14 Drawing Figures

COMPACT APPARATUS FOR LAYING PAVING FABRIC

CROSS REFERENCES TO RELATED APPLICATIONS

The present invention is a continuation-in-part of copending application, Ser. No. 542,475, Filed: 17 Oct., 1985 now abandonded.

BACKGROUND OF THE INVENTION

The present invention relates to a novel and useful apparatus for laying paving fabric.

A recent development in the construction and repair of asphalt surfaces includes the laying of a sheet of paving fabric generally formed from polypropylene, polyethylene or the like. It has been found that the use of paving fabric permits the binding of the old asphalt to the new asphalt overlay while maintaining a moisture impermeable barrier. The result is that reflective cracking of asphalt surfaces is prevented in the future.

In the past, the paving fabric has been placed down manually, but this has proved to be unsatisfactory since the sheet material being unrolled must be aligned with the paving surface perimeter and must be free of wrinkles. Reference is made to the U.S. Pat. No. 3,913,854 to McClure which describes a device for tensioning fabric rolls. The prior art fabric roll laying devices suffer from the inability to accommodate different sized rolls and the elimination of wrinkles from the fabric after it is placed on the surface being paved. In addition, the prior devices have been unwieldy and are not compactly transported from one worksite to another.

A paving machine which overcomes the obstacles and shortcomings of the devices of the prior art would be a great advance in the field of constructing and repairing paved surfaces.

SUMMARY OF THE INVENTION

In accordance with the present invention a novel apparatus for laying paving fabric is provided.

The device of the present application is normally vehicle mounted and dispenses paving fabric from a roll. The apparatus employs a first member which has a lateral or transverse dimension and a second member also having a lateral or transverse dimension such that the members are spaced from one another. The roll is supported from the second member and permitted to unwind with vehicle movement. The fabric is then laid over the surface in this manner.

Means is also used for applying a downward force on the unwound paving fabric as it passes beneath the vehicle; said force applying means being connected to the first member. Such means for applying a downward force on the unwound paving fabric may include a first element and a second element lying adjacent the first element and being angularly disposed in relation to the same. The means for applying a downward pressure or force on the unwound paving fabric may include brushes in the form of first and second elongated brush units each connected to said first and second elements respectively. The brush units may form an angle with the apex of the angle lying closer to the fabric than the legs of the angle. Thus, a vee or a chevron is formed which points toward the direction of travel of the vehicle. The first and second elements may be supported by said second member, although a portion of the first and second elements remains spaced from the second member.

Means is also found in the present invention to adjust the downward force provided by the means for applying the downward force.

The apparatus of the present invention may also embrace the use of means for adjusting the lateral dimension of the second member. Such adjustment may take the form of one or more sections being telescopically movable in relation to one another. Of course, the means for supporting the roll would be attached to an elongated section of the telescopically movable sections.

To maintain the tension on the roll, a bar may be connected to either the first or second member between the fabric roll and the surface. The bar may take the form of a cylindrical member fastened to arms extending from the first or second members. In addition, a platform may be provided on these arms to steady or hold the fabric roll as it is being loaded on the machine.

The apparatus of the present invention may also entail the provision for means for rotating a portion of the first and second members upwardly. Such rotation would place the apparatus in a compact configuration that adds to the mobility of the apparatus. Such folding means may be achieved by the use of a winch, a winch cable and a series of pulleys on the lateral members.

The present application may also be deemed to include a device for supporting a roll of material on a vehicle. The device has first and second arms each including means for tensioning the roll of material. A support bracket adjustably holds the second arm in relation to the first arm. Means is also found for positioning the support bracket to a selected position on the vehicle.

The support bracket may take the form where the support bracket has a sleeve which slidingly engages the second arm. Means holds a portion of the second arm in the sleeve. In addition, the support bracket may rotate in relation to the vehicle. Also, a transverse member may be provided to permit the support bracket to slide transversely from one side of the vehicle to the other.

The front arm may be angularly connected to the vehicle to permit the roll of material on the vehicle to be close to a vertical structure.

A mechanism for stretching the unwinding from the roll may also be deemed as part of the present invention. The mechanism externalizes in a leg affixed to the vehicle and extending therefrom. First and second bars are held to the leg and may include means for positioning the same in relation to one another.

In addition, a mounting system may be employed in the present invention with a frame which includes a pair of spaced bars structurally connected to one another. A pair of brackets are slidably attached to each bar at a desired position. Means is also defined to connect each bracket to the vehicle. The first and second lateral members having arms for engaging the fabric roll may be connected to the mounting system.

It may be apparent that a novel and useful apparatus for laying paving fabric has been described.

It is therefore an object of the present invention to provide an apparatus for laying paving fabric from a roll on a surface which may be operated by a person having a minimum of training and experience.

Another object of the present invention is to provide an apparatus for laying paving fabric which lays the fabric in proper alignment and without wrinkles.

It is yet another object of the present invention to provide an apparatus for laying paving fabric which may employ paving fabric rolls of various sizes.

Another object of the present invention is to provide an apparatus for laying paving fabric which may be collapsible in part to facilitate transportation of the apparatus from job site to job site.

Another object of the present invention is to provide a device for supporting a relatively short roll of fabric for paving on either side of the vehicle supporting such device.

Yet another object of the present invention is to provide a mechanism for stretching a fabric being unrolled to prevent wrinkles from occurring in the laid fabric.

Another object of the present invention is to provide a mounting system for a fabric laying apparatus which is universally attachable to vehicles typically used to lay paving fabric.

The apparatus possess other object and advantages especially as concerns particular characteristics and features which will become apparent as the specification continues.

FIG. *2a* is a top left side perspective view of the apparatus of the present invention depicting the telescoping feature.

FIG. *2b* is a top left side perspective view of the apparatus depicting the telescoping feature.

Figure 3:
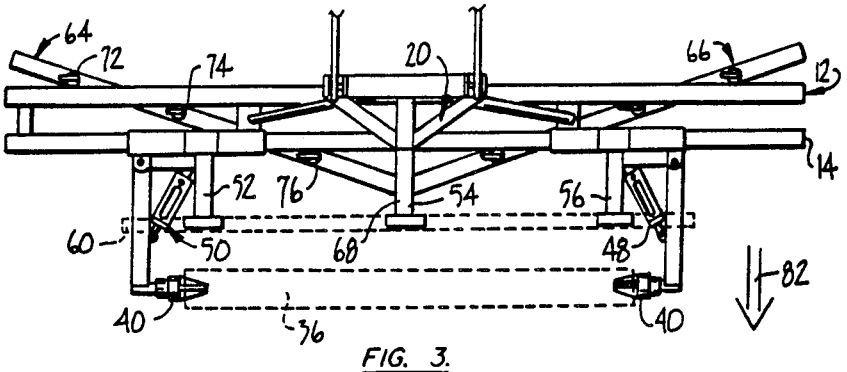

FIG. 3 is a top view showing schematically portions of the apparatus.

Figure 4:
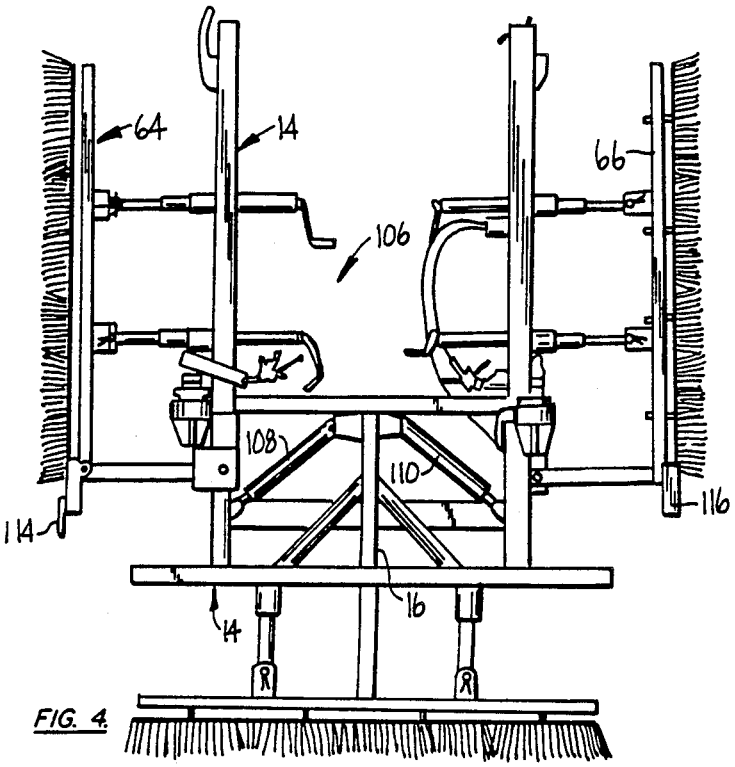

FIG. 4 is a front elevational view of the apparatus showing the upward movements of portions of the apparatus.

Figure 5:
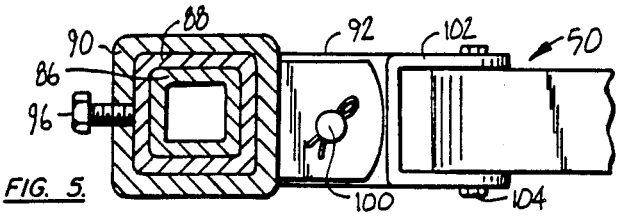

FIG. 5 is a view taken along the line 5—5 of FIG. *2a*.

Figures 1, 6:
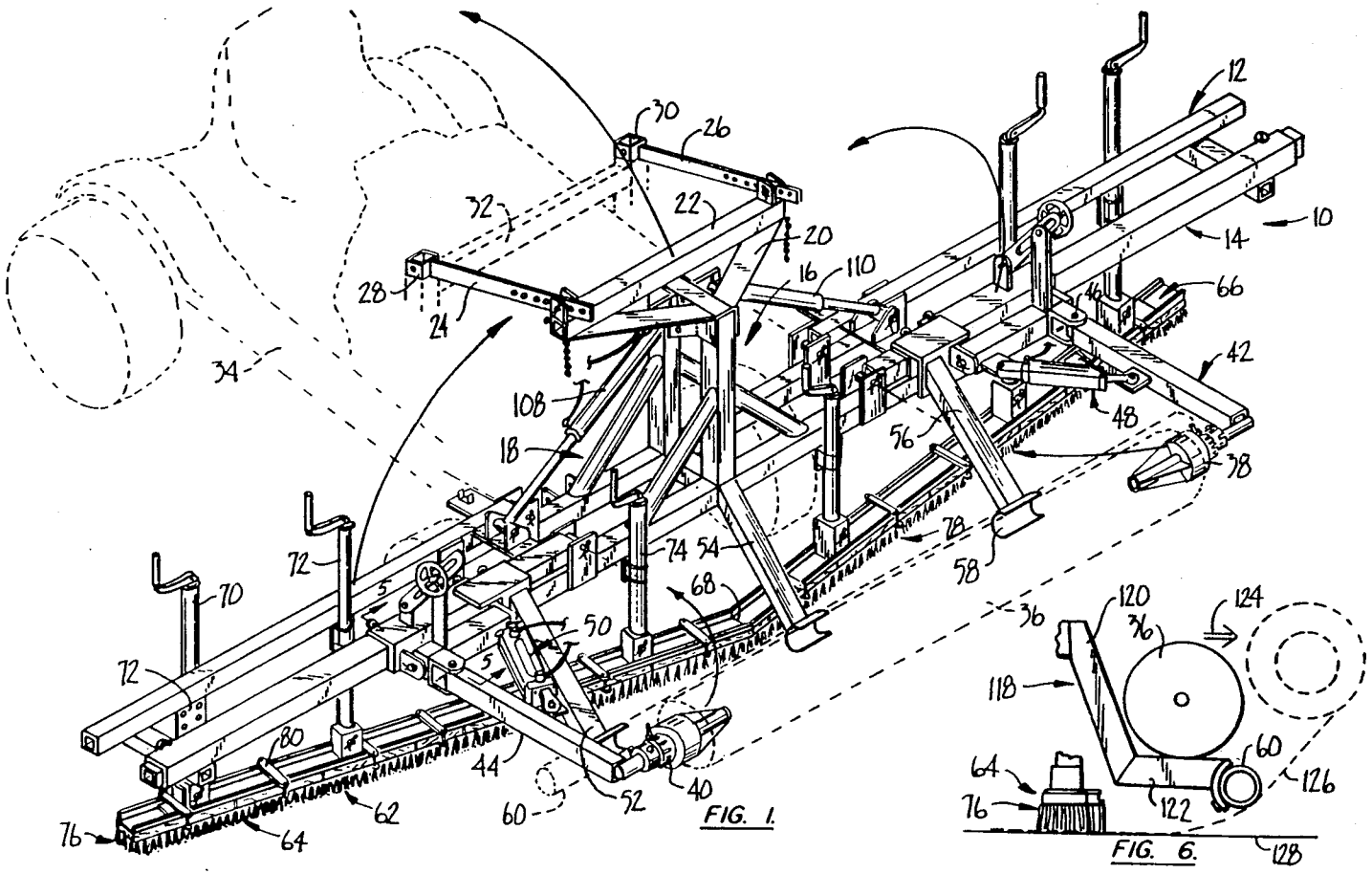
FIG. 1 is a top left side perspective view of the apparatus of the present invention showing the motivating vehicle in phantom.

FIG. 6 is a side view of an embodiment of the rod supporting arm.

Figure 7:
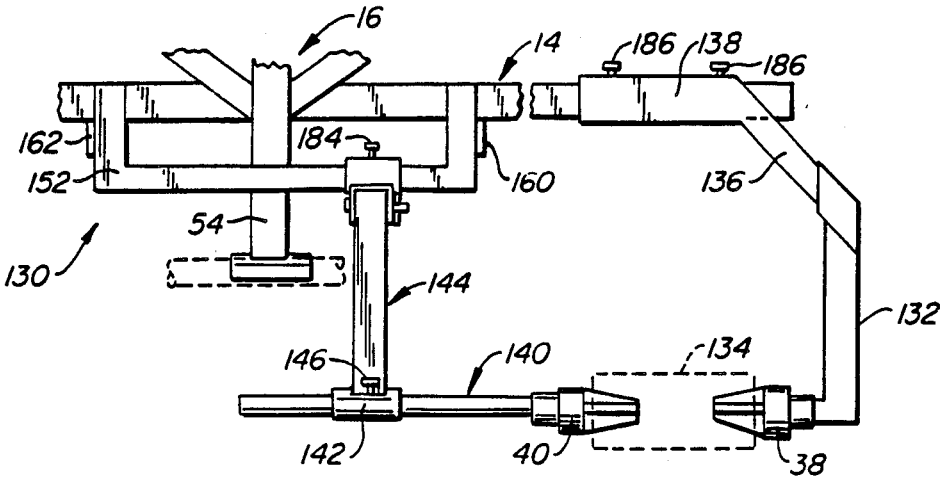

FIG. 7 is a broken top plan view of the device for supporting a short roll on vehicle.

Figure 8:
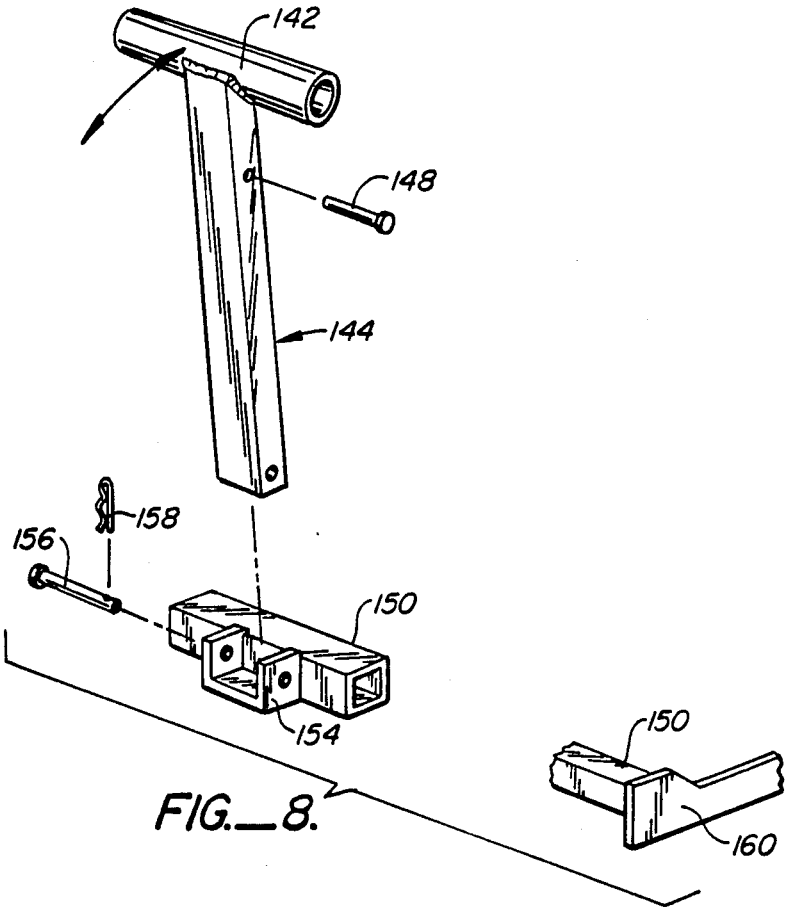

FIG. 8 is an exploded view of portions of the device depicted in FIG. 7.

Figure 9:
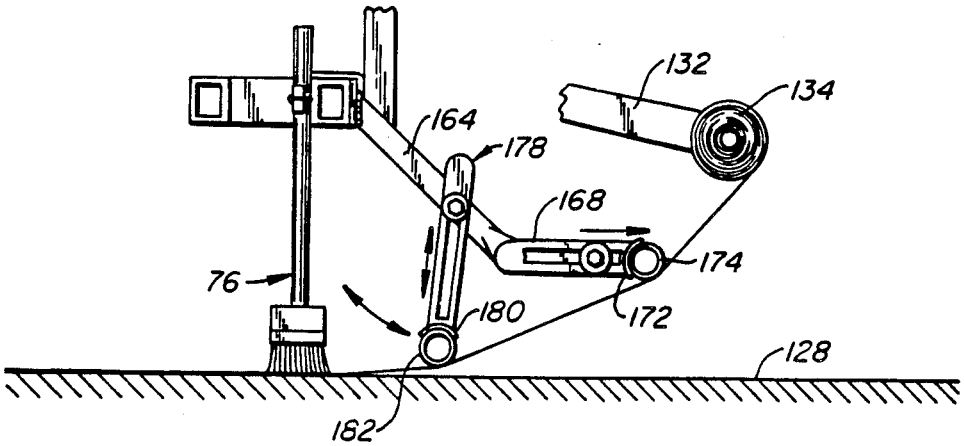

FIG. 9 is a broken side view of a mechanism for stretching the material.

Figure 10:
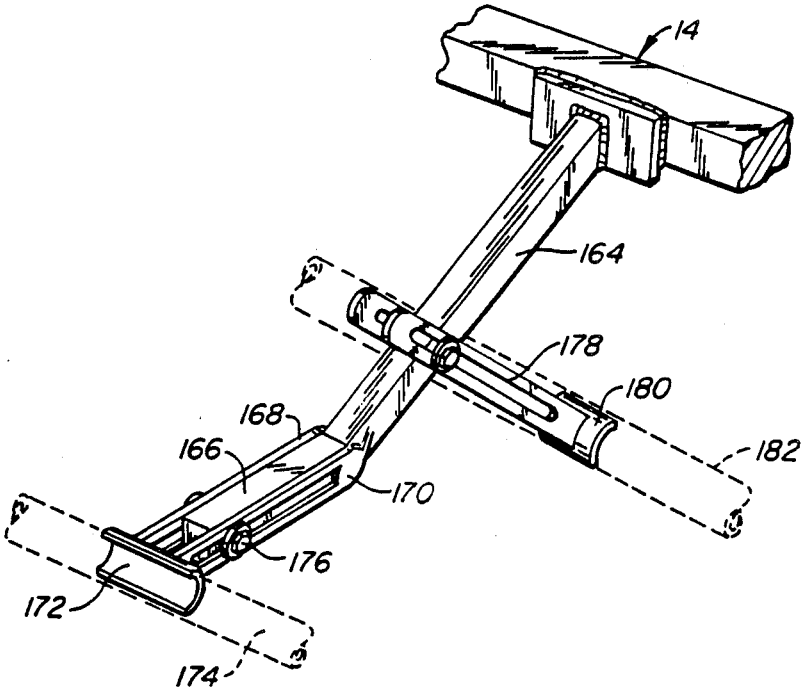

FIG. 10 is a top perspective view of the mechanism shown in FIG. 9 with portions broken in phantom.

Figure 11:
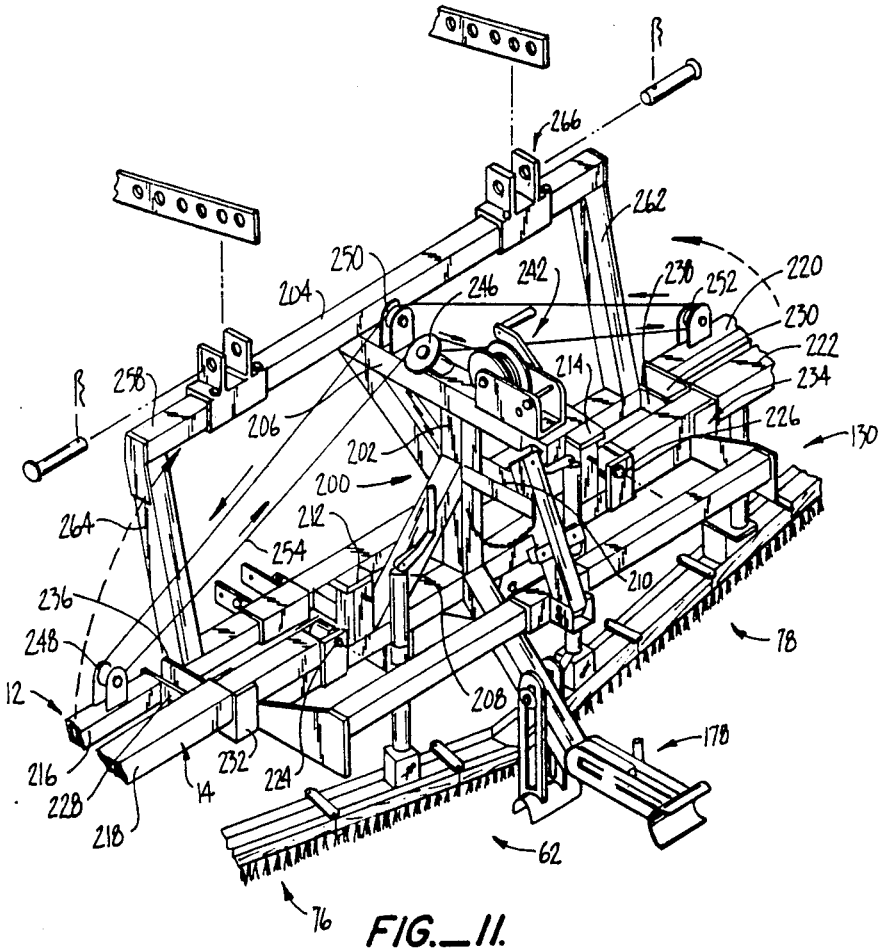

FIG. 11 is a broken to perspective view showing an alternate embodiment of the present invention having a mechanical system for collapsing a portion of the fabric laying machine of the present invention.

Figure 12:
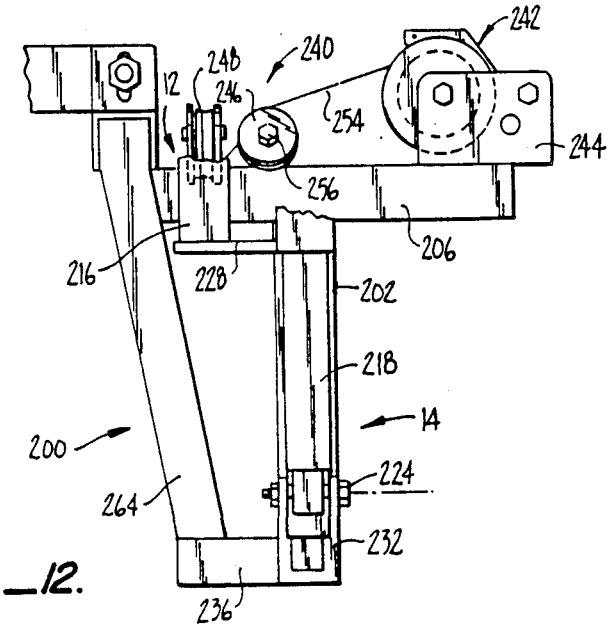

FIG. 12 is a broken left side view of the embodiment of FIG. 11 depicting the lateral member in a partially upwardly rotated position.

Figure 13:
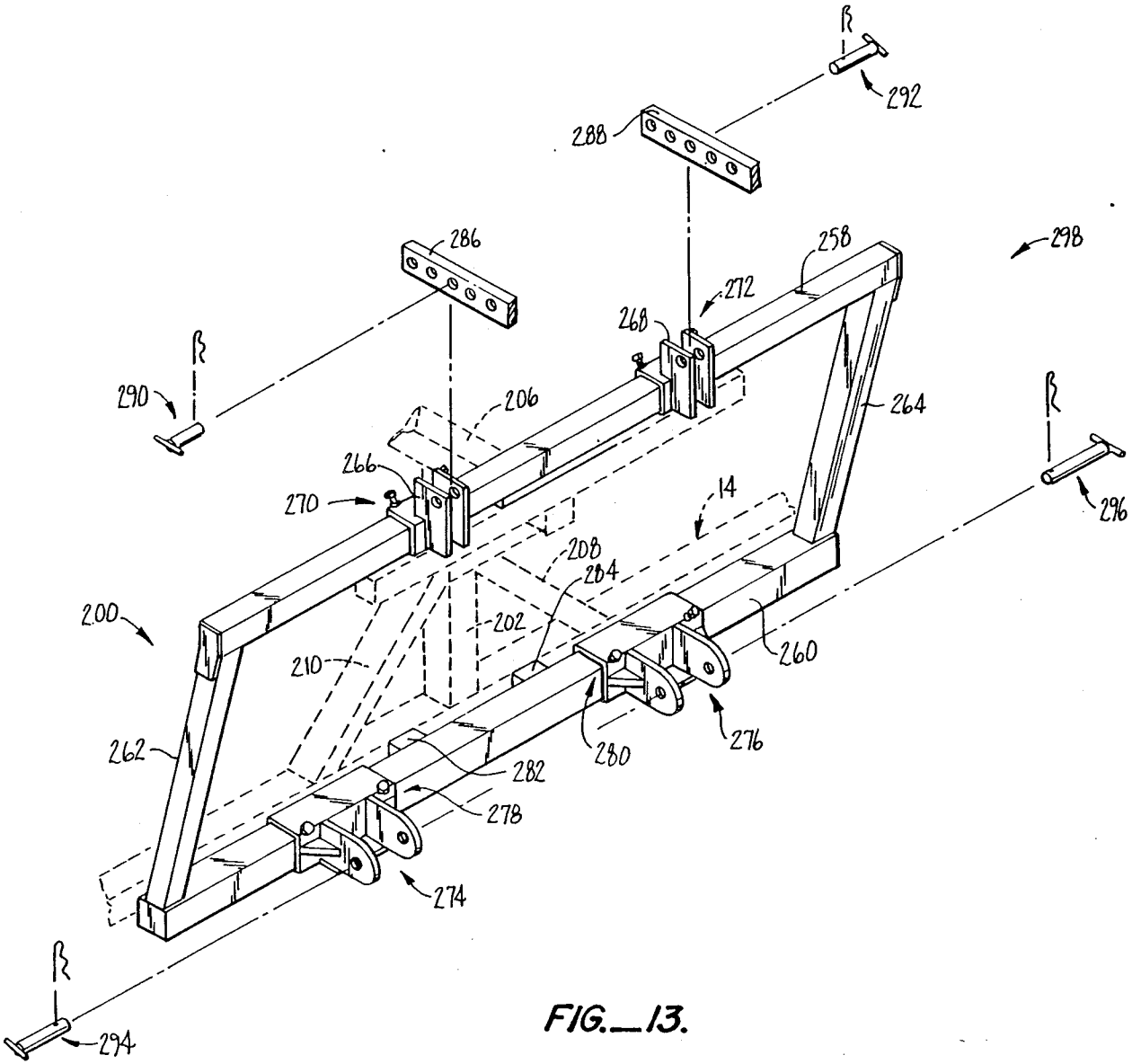

FIG. 13 is top rear perspective view of the embodiment of the invention illustrated in FIGS. 11 and 12 with a portion of the frame in phantom.

For a better understanding of the invention reference is made to the following detailed description of the embodiments of the present invention which should be referenced to the hereinabove drawings.

DETAILED DESCRIPTION OF THE PREFERRED EMBODIMENTS

The apparatus as a whole is shown by reference character 10 in the drawings.

The fabric laying machine 10 includes as one of its elements a first structural member 12 and a second structural member 14. Members 12 and 14 extend transversely and laterally in relation to the paving surface. First member 12 and second member 14 are also spaced in relation to one another in that first member 12 lies behind second member 14. A post member 16 holds first and second members in cantilever fashion. Braces 18 aid in this disposition. A bracket 20 connects to beam 22. Bracket arms 24 and 26 connect to collars 28 and 30 respectively, which fit on support means 32 provided by vehicle 34.

A roll 36 (shown in phantom) in FIG. 1 is held by tensioning spools or chucks 38 and 40, such as the tensioning spool shown in U.S. Pat. No. 3,913,854. Supports 42 and 44 hold tensioning spools in place and are substantially identical in construction to one another. Support 42 includes a pivot 46 which is moved by hydraulic means 48. The movement about pivot 46 would cause tensioning spools 38 and 40 to generally move in or out of roll 36. The hydraulic means 48 is shown in part as a hydraulic cylinder. The remaining portions of hydraulic means 48 are of conventional configuration. Likewise, hydraulic means 50 would similarly operate support 44.

Arms 52, 54, and 56 extend from second member 14 downwardly at an angle. By example, arm 56 includes a semi-cylindrical termination 58 for holding a rod or pipe 60. Unwound fabric from roll 36 would pass beneath pipe 60 and to the surface, as will be hereinafter explained.

Means 62 is also included in the present invention for applying a downward force on the unwound paving fabric. Means 62 may take the form of a first element 64 and a second element 66 which meet at an apex or point of abutment 68. First and second elements 64 and 66 may be included as an integral part of first structural member 12 or formed separately as shown in FIG. 1. By way of illustration, first element 64 is held to a jack 70 by plate 72. Jack 70 would constitute means for adjusting the downward force or pressure of first element 64. Likewise, jack 72 and jack 74 are fixed to the bottom portion of elements 64 and 66 by the plurality of brackets such as bracket 80. Of course, brush units 76 and 78 may be held to first and second elements 64 and 66 by any other known fastening means. Referring to FIG. 3 it may be seen that first and second elements 64 and 66 form a vee or chevron pointing in the direction of movement of the apparatus 10 shown by directional arrow 82. It has been found that this angle of configuration of the brush unit 64 and 66 greatly contributes to the removing of wrinkles from the paving fabric being unwound from roll 36 as it is placed on the surface.

Figure 2A:
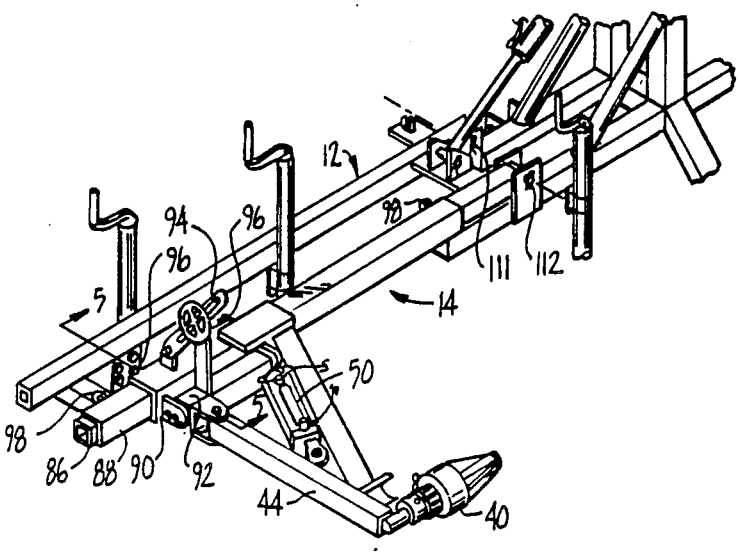
Figure 2B:
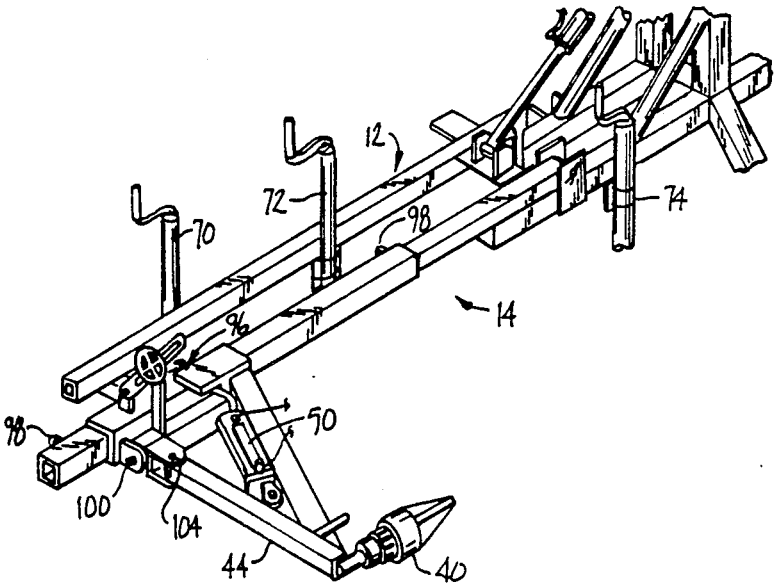

The paving apparatus 10 also includes means 84 for adjusting the lateral dimension of the second member 14. With reference to FIGS. *2a* and *2b* it may be seen that second structural member 14 includes an inner or first elongated section 86, a middle or second elongated section 88, and an outer or third elongated section 90. It should be noted that FIGS. *2a* and *2b* depict the left side of apparatus 10 and that the means for adjusting member 14 includes a similar mechanism for the right side of apparatus 10. With reference to FIG. *2a* it may be seen that support 44 is connected to third elongated section 90 by the use of the pivot block 92. Adjustment means 94 permits the rotation of support 44 upwardly and downwardly as needed to properly tension the roll 36. A set screw or pin 98 is removed to permit third elongated section 90 to slide over second elongated section 88. The removal of pin 98 will permit the second section 88 to slide over the top of first section 86, shown in FIG. 2*b*. Thus, tensioning spool 40 may be moved laterally by the use of means 84. In addition, adjustment means 94 permits rotation of spool upwardly and downwardly and hydraulic means 50 would permit the rotation of spool 40 inwardly and outwardly.

With reference to FIG. 5 it may be seen that one of set pins 96 is shown holding third section 90 to second section 88. Pivot block 92 includes a pivoting rod 100 while hydraulic means 50 is shown to include u-shaped bracket 102 and hinge pin 104.

Turning to FIG. 4 it may be seen that apparatus 10 further comprises means 106 for rotating a portion of first and second structural members 12 and 14 upwardly. Means 106 includes hydraulic cylinders 108 and 110 operated by a conventional hydraulic system such as one having a three quarter ton capacity 11¼" stroke manufactured by A.R.P.S. Manufacturing Inc. In comparison, the hydraulic cylinder systems 48 and 50 would be similar to one having a seven ton capacity and a 6" stroke manufactured by Lantex Hydraulics, Inc. of Lancaster, Tex. Moreover, the screw adjustment jacks 70, 72, and 74 as well as the jacks shown on the right side of the apparatus 10 may be of the type having a 2" diameter 1½ ton capacity manufactured by Atwood Jacks. Hydraulic jacks may be used instead.

First and second members 12 and 14 rotate about pivot 111 and 112. Again, similar rotation pins may be found on the right side of apparatus 10, FIGS. 2*a*, 2*b* and FIG. 1 Returning to FIG. 4, it may be seen that brush units 64 and 66 split and include brackets 114 and 116 to removably fasten the same together.

With reference to FIG. 6 it may be seen that any one of arms 52, 54, or 56 may include the construction shown by arm 118. Arm 118 includes a diagonal section 120 and a horizontal bracket 122 which serves as a resting place for roll 36 before being located on the tensioning spools 38 and 40. Directional arrow 124 shows the movement of roll 36 and the unwinding of the fabric sheet 126 onto surface 128 and beneath brush unit 76.

FIG. 7 depicts a device 130 for supporting a short roll of material to the vehicle 34. Device 130 includes a first arm 132 having means 38 for tensioning the end of the short roll 134, which may have a length as small as eighteen inches. First arm 132 includes an angled portion 136 and a telescoping sleeve 138. Sleeve 138 telescopes in relation to member 14 and is held in place by set screw 186. Angled portion 136 permits the apparatus 10 to travel very close to vertical obstructions, such as curbs, mail boxes, buildings and the like.

A second arm 140 possesses means 40 for tensioning the end of roll 134. Arm 140 is shown in the form of rod which fits through a sleeve 142 in support bracket 144. A set screw 146 will hold second arm 140 within sleeve 142 at various positions.

With reference to FIG. 8, support bracket 144 is shown to include a pin 148 which is employed to support support bracket 144 in a vertical position to post member 16 by use of a string, rope, or chain (not shown). Structural member 150 slides along member 152 which is welded or otherwise attached to member 14. Structural member 150 includes a U-shaped support 154 which engages an end of support bracket 144. Pin 156 and cotter pin 158 hold support bracket 144 to U-shaped support 154. Bases 160 and 162 strengthen member 152 as they are both welded to member 14.

FIG. 9 shows another embodiment of a mechanism for stretching the material unwinding from roll 134. Member 164 is welded to member 14 and angles downwardly. Member 166 extends horizontally in relation to member 164. A pair of slotted members 168 and 170 terminate in semicircular piece 172 to hold bar 174. Bar 174 may be taped or otherwise fastened to terminal member 172. A bolt 176 permits the adjustment of slotted members 168 and 170 such that bar 174 may be positioned transversely in relation to member 164. A second pair of slotted members 178 terminate in a semicircular member 180 to hold bar 182. Thus, a second bar 182 contacts the material from roll 134 to offer a second stretching point thereto. The material then passes under brushes 76 as previously described.

FIG. 11 shows an alternate embodiment of the present apparatus in which a frame 200 is provided. Frame 200 includes a post 202 and brace 204 which support a cross piece 206. A pair of straps 208 and 210 are fixed to second member 14. Stops 212 and 214 also extend from second member 14. Also depicted in FIG. 11 is device 130 for a short roll of fabric, heretofore discussed. In addition, FIG. 11 illustrates a portion of brushes 76 and 78 as well as the pair of slotted member 178 employed for stretching the fabric roll. These items will not be further discussed in FIG. 11.

First and second lateral members 12 and 14 include first portions 216 and 218 and second portions 220 and 222. First portions 216 and 218 of members 12 and 14 lie on one side of frame 200 and the second portions 220 and 222 of members 12 and 14 lie on the other side of frame 200. The first portion 218 and the second portion 222 of second member 14 pivotally attach to frame 200 at pivot pins 224 and 226. First portion 216 and second portion 220 of first member 12 connect to first portion 218 and second portion 222 of second member, respectively by the use of plates of 228 and 230. Plates 228 and 230 are welded or otherwise attached to first and second members 12 and 14.

FIG. 12 illustrates the upward rotational position of first portions 216 and 218 of members 12 and 14 respectively. U-shaped seats 232 and 234 support first portion 218 and second portion 222 of member 14 when that member is in a horizontal position. Plates 236 and 238 hold U-shape seats to frame 200, which will be further described hereinafter. In any case, FIG. 12 is a mirror image of the other side of the apparatus shown in FIG. 11. Therefore, the discussion regarding first portions 216 and 218 of members 12 and 14 also applies to second portions 220 and 222 of members 12 and 14.

Means 240 is also included for rotating members 12 and 14 upwardly from ground surface 128. Means 240 may include a winch 242 held by bracket 244 to cross piece 206. Pulleys 246, 248, 250, and 252 accept pulley cable 254 as shown in FIGS. 11 and 12. Cable 254 leaves winch 242, travels around pulley 246 mounted on cross piece 206, pulley 248 mounted to first portion 216 of member 12, and travels to pulley 250 again mounted on cross piece 206. At this point cable 244 travels to pulley 252 on second portion 220 of member 12 and back to the support 256 for pulley 246, which serves as an anchor for the end of pulley cable 254. Turning winch 242 has a tendency to lift first portions 216 and 218 of members 12 and 14 against stop 212 before second portions 220 and 222 of members 12 and 14 rotate upwardly against stop 214. With reference to FIG. 4, showing the hydraulic collapsing system, a similar configuration is achieved by the embodiment shown in FIG. 11. In both the cases, the lateral dimension of the apparatus of the present invention is decreased.

Moreover, FIG. 13 details frame 200 to a greater degree. First bar 258 and second bar 260 are generally parallel to one another, but connected to one another by connecting pieces 262 and 264. A pair of brackets 266 and 268 slidingly engage first bar 258 and are fixed in position by pairs of set screws 270 and 272. Likewise, brackets 274 and 276 slidingly engage second bar 260 and are held in position therealong by pairs of set screws 278 and 280. It should be noted that supports 282 and 284 interconnect member 14 and second bar 260 for further support. Elongated members 286 and 288 fixed to vehicle 34, FIG. 1 are held to brackets 270 and 272 by releasable pins 290 and 292. Likewise, releasable pins 294 and 296 hold any other pertinent structure (not shown) of vehicle 34 to second bar 260. Thus, FIG. 13 depicts a mounting system 298 which may be employed to connect apparatus 10 to any typical vehicle used in laying of paving fabric, e.g. a tractor, pickup truck, and the like.

In operation, the operator of apparatus 10 would load fabric roll 36 onto tensioning spools 38 and 40. The sheet on 26 would be unwound and led over bar 60 to the bottom of brush units 76 and 78. Means 84 would adjust the proper lateral spacing between tensioning spools 38 and 40 while hydraulic means 48 and 50 would force tensioning spools 38 and 40 into roll 36 as desired. Adjustment means 94 would rotate the roll 36 upwardly or downwardly as necessary to achieve the proper height of the roll above bar 60. The vehicle 34 would then be moved forward and the sheet 126 would be pressed onto surface 128 in a wrinkle-free manner. Jacks 70, 72, 74 and the others hereinbefore referenced, would be adjusted as needed to apply the proper force of the brush unit 76 and 78 to the unwound sheet 126. After being used, means 106 would be employed to raise the outer extremities of first and second members 12 and 14 for the sake of storing or transporting apparatus 10 from one job site to another job site.

Where a shorter roll must be used on either side of the vehicle 34, the embodiments shown in FIGS. 7–10 would be employed. A short roll 134, which may range between ten inches and nine feet, would be positioned on third member 152 by the use of set screw 184. Finally, second arm 140 would slide through sleeve 142 and held by set screw 146 to the proper position such that chuck 40 engages the end of roll 134. First arm 132 would be telescoped along member 14 and held in place by means 186 such that chuck 38 fits within the other end of roll 134. The operator of the apparatus 10 is then ready to lay the material within four inches of any obstructions on the right side of the apparatus as shown in FIG. 7. Of course, second arm 140 may be reversed and placed on the left side of the apparatus as shown in FIG. 7 with a similar arm to first arm 132 thereat. Thus, that short roll 134 may be laid on either side of vehicle 34. With reference to FIG. 9 it may be seen that the material unwinding from roll 134 may be stretched twice by use of bars 174 and 182. The mechanisms hereinbefore described may adjust bars 174 and 182 in relation to one another to achieve the maximum stretching. The end result is that the fabric laid upon surface 128 has a minimum number of wrinkles.

In the embodiments shown in FIGS. 11 and 12, the winching system 240 may be applied, instead of means 106 of FIG. 4, to fold or collapse the extremities of apparatus 10. As heretofore described, either side of apparatus 10 may be raised independently. With one side of apparatus 10 raised either support 42 or 44 may be employed with center support 144. Thus, apparatus 10 may be operated in tight spaces. Finally, mounting system 298 permits apparatus 10 to be affixed to any vehicle 34 and to be easily detached therefrom after use.

While in the foregoing specification embodiments of the present invention have been set forth in considerable detail to the purpose of making a complete disclosure of the invention, it may be apparent to those of skill in the art that numerous changes may be made in such detail without departing from the spirit and principles of the invention.

What is claimed is:

1. A vehicle mounted apparatus for laying paving fabric from a roll on a surface comprising:

a. one member having a lateral dimension, said member including a first portion and a second portion;

b. means for supporting the roll from said one member, for permitting the roll to unwind with vehicle movement and for laying the fabric over the surface, said means for supporting the roll from said one member including a pair of arms appending from said one member, each of said arms engaging opposite ends of fabric roll;

c. a frame including means for attaching said frame to the vehicle, said first and second portions of said one member being pivotally attached to said frame;

d. means for rotating said first and second portions of said one member upwardly from the surface including:

a winch mounted on said frame;

a first pulley mounted on said frame;

a second pulley mounted on said one member first portion;

a third pulley mounted on said one member second portion; and a winch cable capable of being wound and unwound from said winch, said winch cable passing around said first, second, and third pulleys and being fixed to said frame thereafter.

e. another lateral member distinct from said one member having a lateral dimension, said another lateral member having first and second portions each connected to said first and second portions of said one member having a lateral dimension, said first and second portions of said another lateral member rotating upwardly as a result of the operation of said means for rotating said one member upwardly from the surface.

2. The apparatus on claim 1 which additionally comprises a fourth pulley, said fourth pulley being fixed to said frame, said winch cable passing around said fourth pulley between said second and third pulleys.

3. A mounting system for an apparatus for laying paving fabric from a roll on a surface comprising:

a. a frame, said frame including a first bar, a spaced second bar and a member for fixing said first and second bars together;

b. a first pair of brackets for slidingly engaging said first bar along a dimension thereof;

c. means for fixing the position of each of said pair of brackets on said first bar;
d. a third bracket for slidingly engaging said second bar along a dimension thereof;
e. means for fixing said position of said third bracket on said second bar;
f. means for fixing each of said first, second, and third brackets to the vehicle;
g. one member connected to said frame;
h. means for supporting the roll from said one member, for permitting the roll to unwind with vehicle movement and for laying the fabric over the surface, said means for supporting the roll from said one member including a pair of arms appending from said one member, each of said arms engaging opposite ends of the fabric roll.

4. The mounting system of claim 3 which further includes a fourth bracket slidingly engaging said second bar, and further includes means for fixing said fourth bracket to the vehicle.

* * * * *